US009033481B2

(12) United States Patent
Kinokuni et al.

(10) Patent No.: US 9,033,481 B2
(45) Date of Patent: May 19, 2015

(54) LIQUID DROPLET EJECTION HEAD, IMAGE FORMING APPARATUS, AND MANUFACTURING METHOD OF LIQUID DROPLET EJECTION HEAD

(71) Applicants: Takashi Kinokuni, Tokyo (JP); Keisuke Hayashi, Kanagawa (JP); Tatsuya Shimoda, Kanagawa (JP)

(72) Inventors: Takashi Kinokuni, Tokyo (JP); Keisuke Hayashi, Kanagawa (JP); Tatsuya Shimoda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 124 days.

(21) Appl. No.: 13/719,553

(22) Filed: Dec. 19, 2012

(65) Prior Publication Data

US 2013/0155159 A1 Jun. 20, 2013

(30) Foreign Application Priority Data

Dec. 20, 2011 (JP) ..... 2011-278473
Oct. 18, 2012 (JP) ..... 2012-230982

(51) Int. Cl.
*B41J 2/175* (2006.01)
*B41J 2/14* (2006.01)

(52) U.S. Cl.
CPC ..... *B41J 2/17563* (2013.01); *B41J 2/14274* (2013.01); *B41J 2002/14403* (2013.01)

(58) Field of Classification Search
None
See application file for complete search history.

(56) References Cited

U.S. PATENT DOCUMENTS

| | | | | |
|---|---|---|---|---|
| 4,904,394 | A * | 2/1990 | Clarke et al. | 210/739 |
| 6,464,347 | B2 * | 10/2002 | Kneezel et al. | 347/93 |
| 6,685,299 | B2 * | 2/2004 | Hirota | 347/20 |
| 7,364,285 | B2 * | 4/2008 | Murad et al. | 347/94 |
| 7,448,741 | B2 * | 11/2008 | von Essen | 347/93 |
| 7,475,975 | B2 * | 1/2009 | Shimizu | 347/93 |
| 7,775,652 | B2 * | 8/2010 | Taira et al. | 347/93 |
| 7,878,638 | B2 * | 2/2011 | Akase et al. | 347/92 |
| 7,926,916 | B2 * | 4/2011 | Schmidt et al. | 347/63 |
| 8,348,407 | B2 * | 1/2013 | Matsufuji et al. | 347/93 |
| 2002/0171715 | A1 * | 11/2002 | Takahagi et al. | 347/70 |
| 2002/0180844 | A1 * | 12/2002 | Takahagi et al. | 347/70 |
| 2004/0179057 | A1 * | 9/2004 | Yamada | 347/20 |
| 2004/0179073 | A1 * | 9/2004 | Valley et al. | 347/93 |
| 2004/0257415 | A1 * | 12/2004 | Arakawa et al. | 347/93 |

(Continued)

FOREIGN PATENT DOCUMENTS

| | | |
|---|---|---|
| JP | 2007-253439 | 10/2007 |
| JP | 2008-213196 | 9/2008 |

(Continued)

*Primary Examiner* — Julian Huffman
*Assistant Examiner* — Leonard S Liang
(74) *Attorney, Agent, or Firm* — Cooper & Dunham LLP

(57) ABSTRACT

A liquid droplet ejection head includes plural nozzles; plural individual liquid chambers; a common liquid chamber supplying liquid to the plural individual liquid chambers; a filter sheet member including plural pores formed therein to filter the liquid; and a frame body including an opening part and being in connection with the filter sheet member with adhesive. Further, a size of a region where the plural pores are formed is greater than the opening part of the frame body; an adhesive accumulation area is formed on an inner peripheral end of the opening part; and a size of the adhesive accumulation area in a protruding direction of the adhesive is greater than a size of an area between adjacent pores in the filter sheet member.

4 Claims, 16 Drawing Sheets

(56) References Cited

U.S. PATENT DOCUMENTS

| | | | | |
|---|---|---|---|---|
| 2005/0099472 | A1* | 5/2005 | Kerr et al. | 347/86 |
| 2005/0116989 | A1* | 6/2005 | Chikamoto | 347/40 |
| 2006/0001718 | A1 | 1/2006 | Shimizu | |
| 2006/0017766 | A1* | 1/2006 | Ito | 347/20 |
| 2007/0002108 | A1* | 1/2007 | Sugahara | 347/92 |
| 2008/0180500 | A1* | 7/2008 | Sugahara | 347/93 |
| 2008/0303884 | A1 | 12/2008 | Miura | |

FOREIGN PATENT DOCUMENTS

| | | | |
|---|---|---|---|
| JP | 4186884 | | 11/2008 |
| JP | 2009113250 | A * | 5/2009 |

* cited by examiner

LIQUID DROPLET EJECTION HEAD, IMAGE FORMING APPARATUS, AND MANUFACTURING METHOD OF LIQUID DROPLET EJECTION HEAD

CROSS-REFERENCE TO RELATED APPLICATIONS

The present application claims priority under 35 U.S.C. §119 based on Japanese Patent Application Nos. 2011-278473 filed Dec. 20, 2011 and 2012-230982 filed Oct. 18, 2012, the entire contents of which are hereby incorporated herein by reference.

BACKGROUND OF THE INVENTION

1. Field of the Invention

The present invention generally relates to a liquid droplet ejection head, an image forming apparatus, and a manufacturing method of the liquid droplet ejection head 2. Description of the Related Art As an image forming apparatus such as a multifunctional peripheral including a printer, a facsimile machine, a copier, and a plotter, there has been known an image forming apparatus, such as an inkjet recording apparatus, employing a liquid droplet ejection recording method using a recording head including a liquid droplet ejection head ejecting ink droplets or the like.

SUMMARY OF THE INVENTION

According to an embodiment, a liquid droplet ejection head includes plural nozzles ejecting liquid droplets; plural individual liquid chambers in communication with the plural nozzles; a common liquid chamber supplying liquid to the plural individual liquid chambers; a filter sheet member disposed in a liquid flow path to supply liquid from the common liquid chamber to the plural individual liquid chambers and including plural pores formed therein to filter the liquid; and a frame body including an opening part and being in connection with the filter sheet member with adhesive applied therebetween. Further, a size of a region where the plural pores are formed in the filter sheet member is greater than a size of the opening part of the frame body; an adhesive accumulation area where the adhesive protruded due to the connection is accumulated is formed on an inner peripheral end of the opening part of the frame body; and a size of the adhesive accumulation area in a protruding direction of the adhesive is greater than a size of an area between adjacent pores in the filter sheet member.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

Figure 1:
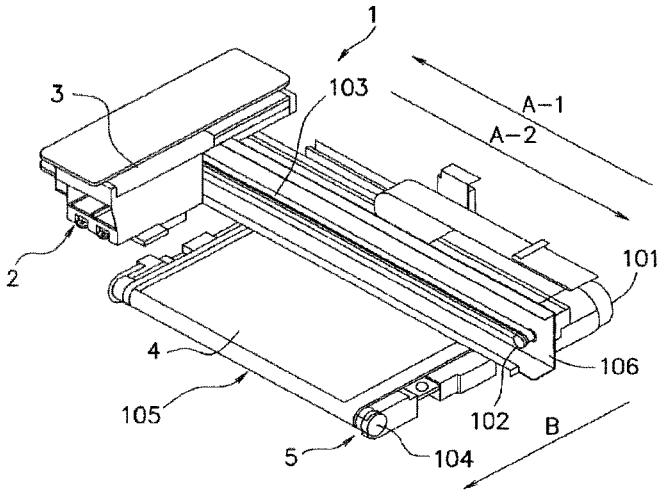
FIG. 1 is an oblique view of an example mechanical part of an image forming apparatus according to an embodiment of the present invention.

There has been known a liquid droplet ejection head including a filter member disposed in the liquid droplet ejection head. Further, the filter filters a liquid to a common liquid chamber supplying liquid to plural individual liquid chambers in communication with nozzles ejecting liquid droplets.

This type of the filter member includes two parts: a filter sheet member and a frame body. The filter sheet member has a thin plate shape, and plural fine pores are formed through the filter sheet member. The frame body has an opening part.

The filter sheet member and the frame body are integrally joined to each other with adhesive to form the filter member, so that the filter member and the frame member form the common liquid chamber.

Further, the size of the area where the fine pores are formed in the filter sheet member is greater than the size of the opening part of the frame body. This is because bubbles generated on the downstream side in a liquid supply path of the filter member can promptly pass through the filter member and be exhausted to the upstream side.

By having the structure, a fine pore formed area (i.e. an area where fine pores are formed) of the filter sheet member is always disposed directly on the upper side of the opening part of the frame body, so that bubbles generated on the downstream side of the filter member may be promptly exhausted to the upstream side of the filter member. This structure is already known.

However, in the filter member where the frame body and the filter sheet member are joined (adhered) to each other with adhesive or the like, adhesive may be extruded.

In this case, adhesive may be extruded to the opening part of the frame body, so that some of the fine pores formed through the filter sheet member may be sealed with the extruded adhesive.

The smaller the liquid droplet ejection head becomes, the more serious becomes the problem of sealing the fine pore formed area with adhesive. Namely, when the size of the liquid droplet ejection head is reduced, the size of the filter sheet member of the liquid droplet ejection head is accordingly reduced. As a result, if even a small amount of adhesive is extruded, the fine pore formed area may be more likely to be sealed with the extruded adhesive.

When the fine pore formed area of the filter sheet member is partially sealed, a liquid resistance of the liquid passing through the filter member may be increased, so that a liquid supply to the nozzles may be withheld. As a result, the liquid may not be ejected well.

In addition, the bubbles generated on the downstream side of the filter member in a liquid supply direction may pass through the frame body but may be trapped in an area where the fine pores are filled with adhesive. Namely, the bubbles may remain in the area.

The filter member is typically disposed at a position relatively close to the nozzles in the common liquid chamber. Therefore, the remaining bubbles may reach the nozzles, so that liquid may not be ejected well.

To prevent such clogging of the fine pores with adhesive to be used to join members, there is a known technique in which, when the ink inlet of the head unit and the connection pore of the connecting member are connected via the filter body, to prevent the clogging of the filter member with adhesive that is interposed between the head unit and the filter member or between the connection member and the filter member, there are formed two rows of concave parts on a peripheral of the filter member at the connecting hole of the connecting member (see Japanese Patent Application Publication No. 2007-253439).

On the other hand, Japanese Patent Application Publication No. 2007-253439 further describes the area being provided (formed) so that the adhesive at the peripheral on the filter member side may be excluded throughout the area, and further describes that the connecting member is made of a rigid metal plate such as SUS (Steel Use Stainless).

However, to realize the filter member having such a shape, a secondary process (i.e., an additional process) may become necessary. This is because the concave part is different from the ink liquid path area, and is not such as a through hole.

As are result, it may become necessary to separately form the concave part in a process other than a process of forming the through hole. Therefore, the cost may be accordingly increased.

Further, in Japanese Patent Application Publication No. 2007-253439, the concave part having a complicated shape is formed by removing the connecting area which is typically formed in related art. Due to this structure, the connecting strength may be reduced. If this problem is to be resolved, the size of the head may be increased.

According to an embodiment of the present invention, there are provided a liquid droplet ejection head, an image forming apparatus, and a manufacturing method of the liquid droplet ejection head, which may stably eject liquid droplets without increasing cost of parts and without necessarily increasing the size.

In the following, embodiments of the present invention are described with reference to the drawings.

First, an example image forming apparatus including a liquid droplet ejection head according to an embodiment is described with reference to FIG. FIG. 1 is a schematic oblique view of an example mechanical part of an image forming apparatus according to an embodiment of the present invention.

As illustrated in FIG. 1, a drive unit 1 includes a guide rod 106, a carriage 3, a main-scanning motor 101 disposed at one end (at the right end in FIG. 1) of the guide rod 106, a pulley 102 fixed to an output axle of the main-scanning motor 101, a pulley (not shown) disposed at the other end (at the Left end in FIG. 1) of the guide rod 106, and a belt (fixing belt) 103.

The guide rod 106 is disposed in the direction parallel to the main scanning directions A-1 and A-2. The carriage 2 is slidably provided along the guide rod 106. The belt 103 is bridged and rotated between the pulleys, and a part of the belt 103 is fixed to or in contact with the carriage 3 while being rotated.

The carriage 3 is moved and scanned in the main scanning directions A-1 and A2 by being driven by the main-scanning motor 101 via the fixing belt 103.

The drive unit 1 further includes a roller 104 disposed under the guide rod 106 so as to be parallel to the guide rod 106, a roller (not shown) disposed parallel to the roller 104 so as to face the roller 104, a belt 105 bridged and rotated between the rollers, a sub-scanning motor (not shown) for conveying the belt 105 in the sub scanning direction B, and a control circuit that controls the rotation and stopping of the main-scanning motor 101 and the motor (not shown).

The carriage 3 includes a liquid droplet ejection head 2.

As described in FIGS. 2A through 4 below, the liquid droplet ejection head 2 includes plural nozzles, plural individual liquid chambers which are in communication with the plural nozzles, a common liquid chamber supplying liquid to the plural individual liquid chambers, a filter member that is disposed between the common liquid chamber and the plural individual liquid chambers and in which plural holes are formed to filter liquid, and a ink tank (not shown).

This image forming apparatus forms one line of a divided image on a medium 4 by ejecting liquid droplets from the liquid droplet ejection head 2 disposed on the carriage 3 moving in the main scanning directions A-1, A-2 back and forth.

After one line of the divided image is formed, the medium 4 is fed in the sub scanning direction B by one line by a feeding mechanism 5 (i.e., a mechanism including the belt 105, the roller 104, and sub-scanning motor) in the main body of the image forming apparatus.

After feeding the medium 4, the next one line of the divided image is formed by moving the carriage 3 in the main-scanning direction again.

After that, by repeating those operations, a desired image may be formed on the medium 4.

Figure 2A:
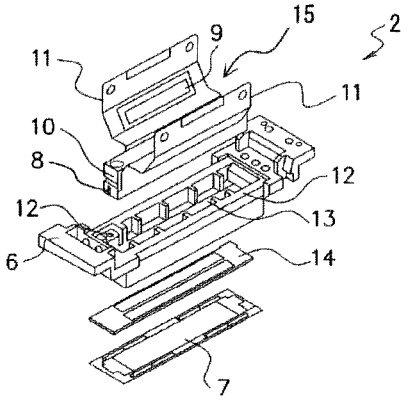
FIG. 2A is an exploded oblique view of an example liquid droplet ejection head according to an embodiment.
Figure 2B:
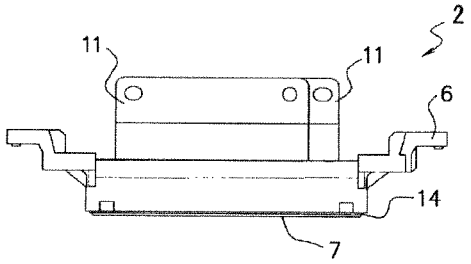
FIG. 2B is a side view of the liquid droplet ejection head after parts of the liquid droplet ejection head in FIG. 2A are assembled.
Figure 2C:
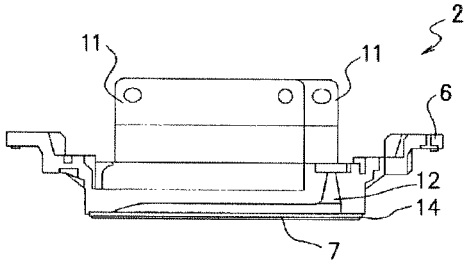
FIG. 2C is a side cut-away view of the liquid droplet ejection head in FIG. 2B.

Next, an example of the entire configuration of the liquid droplet ejection head 2 according to an embodiment in the image forming apparatus with reference to FIGS. 2A through 2C.

FIG. 2A is an exploded oblique view of an example liquid droplet ejection head according to an embodiment. FIG. 2B is a side view of the liquid droplet ejection head after parts of the liquid droplet ejection head in FIG. 2A are assembled. FIG. 2C is a side cut-away view of the liquid droplet ejection head in FIG. 2B.

As illustrated in FIG. 2A, the liquid droplet ejection head 2 includes a liquid chamber member 7, a piezo actuator 15, a frame 6 forming a common liquid chamber 12, and a filter member 14 disposed on the downstream side of the liquid supply direction the frame 6.

Next, details of a flow-path configuration in the liquid droplet ejection head 2 are described with reference to FIGS. 3 and 4.

Figure 3:
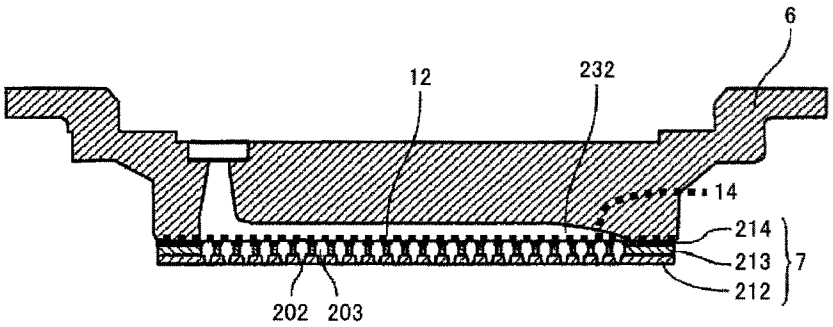
FIG. 3 is a cut-away view cut along a nozzle arranging direction of the liquid droplet ejection head according to an embodiment.
Figure 4:
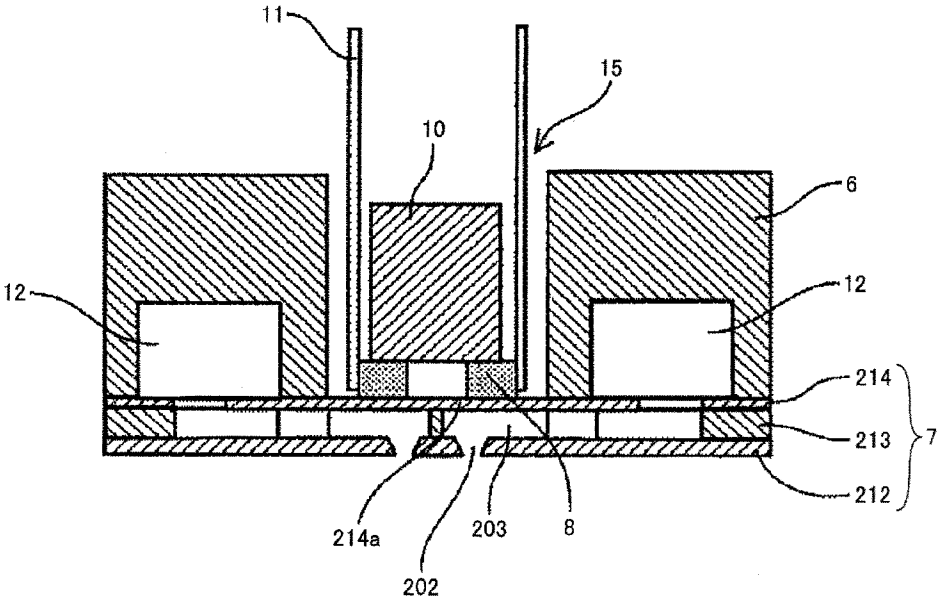
FIG. 4 is a cut-away view cut along a direction orthogonal to the nozzle arranging direction of the liquid droplet ejection head according to an embodiment.

FIG. 3 is a cut-away view cut along a nozzle arranging direction of the liquid droplet ejection head according to an embodiment. FIG. 4 is a cut-away view cut along a direction orthogonal to the nozzle arranging direction of the liquid droplet ejection head according to an embodiment.

Further, in FIG. 3, in the direction orthogonal to the nozzle arranging direction, the view is cut along the flow path part. The liquid chamber member 7 includes a nozzle plate 212, a flow path plate 213, and a vibration plate member 214 which are joined as illustrated in FIG. 3.

In the nozzle plate 212, for example, plural nozzles 202 ejecting liquid droplets are arranged in two lines (rows) so that the plural nozzles are arranged in a zig-zag manner. For example, the nozzle plate 212 may be made of stainless by press working.

The flow path plate 213 forms individual liquid chambers 203 in communication with the respective nozzles 202. For example, the flow path plate 213 may be formed by anisotropic etching and may be made of a metal materials such as stainless.

The vibration plate member 214 is formed as a vibrational region 214*a* that may displace a wall surface which is a part of the individual liquid chamber 203. The vibration plate member 214 is formed by Ni (Nickel) electrocasting.

In the frame 6, the common liquid chamber 12 to which liquid is supplied from the ink tank (not shown) is formed, so that liquid is supplied from the common liquid chamber 12 to the individual liquid chambers 203.

As described in detail below with reference to FIG. 5, the filter member 14 is a composite product including an opening part. The filter member 14 is disposed in the liquid supply path through which liquid is supplied from the common liquid chamber 12 formed in the frame 6 to the individual liquid chambers 203, and includes plural fine pores 232 (FIG. 3) to filter impurities from liquid supplied to the individual liquid chambers 203.

Further, in an inner space 13 the piezo actuator 15 is disposed in a side opposite to the side of the individual liquid chambers 203 of the vibrational region 214*a* of the vibration plate member 214. In the piezo actuator 15, in conformity with the two lines of the nozzles, two piezo members 8 which are piezo elements (piezo poles) having a columnar shape are connected to (placed on) a base member 10.

Further, a pitch of the piezo elements 8 is twice the height as the pitch of the nozzles 202. The piezo poles of the piezo members 8 are connected to the vibrational region 214*a* of the vibration plate member 214. Further, piezo poles of the piezo members 8 are connected to flexible wiring members 11 such as FPC and FEC, so that a drive signal is applied through the flexible wiring members 11 by a driving circuit (driver IC) 9 mounted on the flexible wiring member 11.

In this liquid droplet ejection head 2, by driving the piezo actuator 15, the vibrational region 214*a* of the vibration plate member 214 may be displaced, so that a pressure of the liquid in the individual liquid chambers 203 is increased to eject liquid droplets from the nozzles 202.

Next, the filter member 14 to be used in the liquid droplet ejection head according to an embodiment is described.

More specifically, with reference to FIGS. 5A through 5F, the filter member 14 and the parts thereof are described.

Figure 5A:
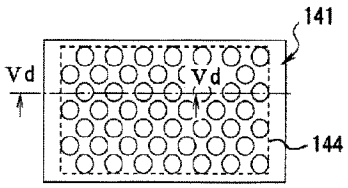
FIG. 5A is a top view of a filter sheet member according to a first embodiment.

FIG. 5A is a top view of a filter sheet member 144 according to a first embodiment. FIG. 5B is a top view of a frame body 142 according to a first embodiment. FIG. 5C is a top view of the filter member 14 according to the first embodiment when viewed from an upstream side in a liquid supply direction.

Figure 5D:
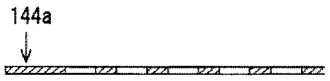
FIG. 5D is a cut-away view of the filter sheet member in FIG. 5A when cut along a line Vd-Vd.
Figure 5B:
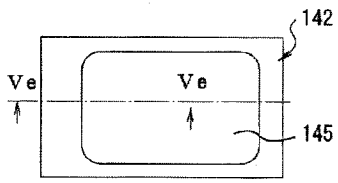
FIG. 5B is a top view of a frame body according to the first embodiment.
Figure 5E:
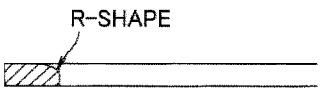
FIG. 5E is a cut-away view of the frame body in FIG. 5B when cut along a line Ve-Ve.
Figure 5C:
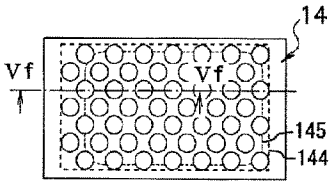
FIG. 5C is a top view of a filter member according to the first embodiment when viewed from an upstream side in a liquid supply direction.
Figure 5F:
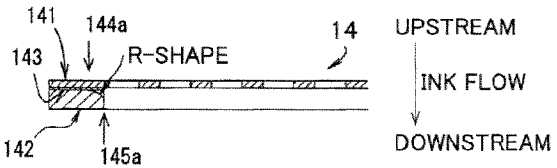
FIG. 5F is a cut-away view of the filter member in FIG. 5C when cut along a line Vf-Vf.

FIG. 5D is a cut-away view of the filter sheet member 144 in FIG. 5A when cut along a line Vd-Vd. FIG. 5E is a cut-away view of the frame body 142 in FIG. 5B when cut along a line Ve-Ve. FIG. 5F is a cut-away view of the filter member 14 in FIG. 5C when cut along a line Vf-Vf.

The filter member 14 includes the filter sheet member 141 and the frame body 142 as the frame of the filter member 14. For example, the filter sheet member 141 is a filter member made of a thin-film Ni material and is formed by electrocasting. Further, as schematically illustrated in FIG. 5A, the filter sheet member 141 includes a fine pore formed area 144 where plural pores (fine pores) (holes) are formed. The fine pore formed area 144 is defined by dotted lines in FIG. 5A.

The frame body 142 is a frame part to which the fine pore formed area 144 is to be attached. The frame body 142 includes an opening part 145 which is formed by press punching work. The frame body 142 is made of a SUS material or the like.

Further, by an adhesive layer 143 supplying between the filter sheet member 141 and the frame body 142, the filter sheet member 141 and the frame body 142 are joined to each other via the adhesive layer 143 so that the filter member 14 is formed.

Further, in the filter member 14 in this embodiment, as illustrated in FIG. 50, the fine pore formed area 144 of the filter sheet member 141 is formed so that the fine pore formed area 144 of the filter sheet member 141 is larger (wider) than the opening part 145 of the frame body 142.

Namely, an edge part 144*a* of the fine pore formed area 144 of the filter sheet member 141 is disposed outside of an edge part 145*a* forming an opening part of the opening part 145 of the frame body 142.

With reference to FIGS. 6A through 7B, a difference in bubble discharging performance depending on size difference between the fine pore formed area 144 and the opening part 145 of the frame body 142 is described.

Figure 6B:
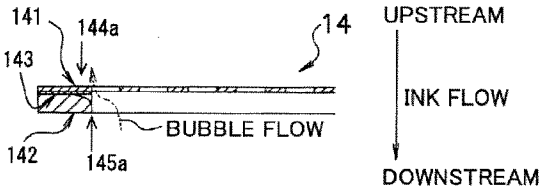
FIG. 6B is a cut-away view of the filter member in FIG. 6A when cut along a line VIb-VIb.
Figure 6A:
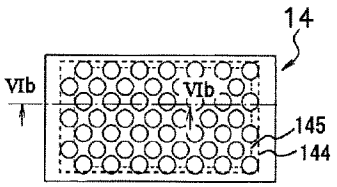
FIG. 6A is a top view of a filter member according to the first embodiment when viewed from the upstream side in the liquid supply direction.

FIG. 6A is a top view of a filter member according to the first embodiment when viewed from the upstream side in the liquid supply direction. FIG. 6B is a cut-away view of the filter member in FIG. 6A when cut along a line VIb-VIb.

Figure 7B:
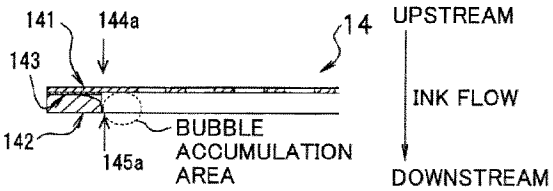
FIG. 7B is a cut-away view of the filter member in FIG. 7A when cut along a line VIIb-VIIb.
Figure 7A:
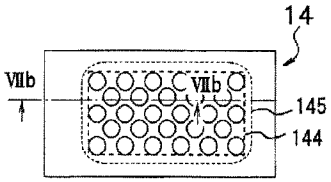
FIG. 7A is a top view of a comparative example of a filter member when viewed from the upstream side in the liquid supply direction.

FIG. 7A is a top view of a comparative example of a filter member when viewed from the upstream side in the liquid supply direction. FIG. 7B is a cut-away view of the filter member in FIG. 7A when cut along a line VIIb-VIIb.

In the comparative example of the filter member 14 of FIGS. 7A and 7B, the fine pore formed area 144 is formed so that the fine pore formed area 144 is smaller than the opening part 145 of the frame body 142.

In the filter member 14 in this embodiment of FIG. 6A, the fine pore formed area 144 is formed so that the fine pore formed area 144 is larger than the opening part 145 of the frame body 142. In this case, bubbles generated (formed) on the downstream side of the filter member 14 (i.e., on the liquid chamber member 7 side) and attached to a wall surface of the frame body 142 are going up toward the upstream side along the wall surface of the frame body 142 due to buoyancy (ascending force).

The bubbles going up promptly pass through the filter sheet member 141 and are discharged upward (to the upstream side). By doing this, bubbles generated on the downstream side do not reach the nozzles. Therefore, it may become possible to prevent ink clogging.

On the other hand, the comparative example of the filter member of FIG. 7A indicates a case where the fine pore formed area 144 is formed so that the fine pore formed area 144 is smaller than the opening part 145 of the frame body 142.

In this case, as illustrated in FIG. 7B, some of the bubbles generated (formed) on the downstream side of the filter member 14 (i.e., on the liquid chamber member 7 side) and attached to a wall surface of the frame body 142 may not be discharged toward the upstream side due to the filter sheet member 141 disposed on the upstream side.

Namely, in this area, a bubble accumulation (stagnation) area is generated. Due to the bubble accumulation area, bubbles generated on the downstream side may reach the nozzles, so that ink clogging may occur.

Next, a shape of inner periphery of the opening part of the frame body of the filter member is described with reference to FIGS. 8A through 9B.

Figure 8B:
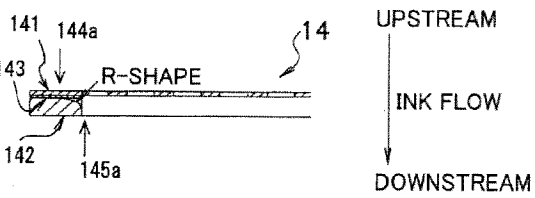
FIG. 8B is a cut-away view of the filter member in FIG. 8A when cut along a line VIIIb-VIIIb.
Figure 8A:
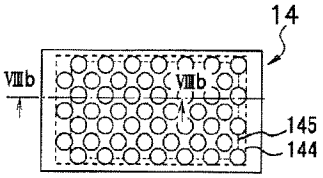
FIG. 8A is a top view of a filter member according to the first embodiment when viewed from the upstream side in the liquid supply direction.

FIG. 8A is a top view of the filter member according to the first embodiment when viewed from the upstream side in the liquid supply direction.

FIG. 8B is a cut-away view of the filter member in FIG. 8A when cut along a line VIIIb-VIIIb.

Figure 9B:
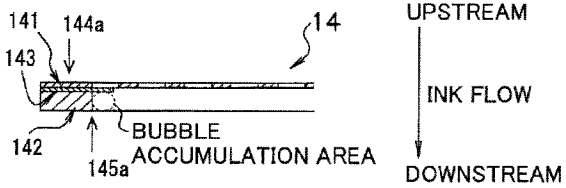
FIG. 9B is a cut-away view of the filter member in FIG. 9A when cut along a line IXb-IXb.
Figure 9A:
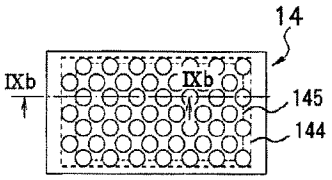
FIG. 9A is a top view of a comparative example of a filter member when viewed from the upstream side in the liquid supply direction.

FIG. 9A is a top view of a comparative example of a filter member when viewed from the upstream side in the liquid supply direction. FIG. 9B is a cut-away view of the filter member in FIG. 9A when cut along a line IXb-IXb.

In the filter member 14 according to this embodiment, an R-shape (i.e., a round shape) is formed from the downstream side to the upstream side in the liquid flowing direction on the (inner) periphery of the opening part 145 of the frame body 142.

On the other hand, in the comparative example of the filter member 14 in FIGS. 9A and 9B, no such R-shape (i.e., a round shape) is formed in the liquid flowing direction on the (inner) periphery of the opening part 145 of the frame body 142.

In this embodiment, as described above, adhesive is used to join parts. More specifically, adhesive is first applied to one of plane areas of the parts (i.e., the filter sheet member 141 and the frame body 142), the plane areas facing each other.

In a process of assembly, when those parts sandwich adhesive, the adhesive forms the adhesive layer 143. By sandwiching and pressing the adhesive layer 143 by the two parts, the adhesive layer 143 becomes hardened to complete joining of the two parts.

In this case, due to the pressing the adhesive layer 143, the adhesive layer 143 becomes thinner and extends. As a result, the adhesive layer 143 may protrude beyond the area where the plane areas of the two parts face each other.

The protruded adhesive from the area may accumulate (stagnate) due to capillarity in an adhesive accumulation area which is formed due to the R-shape of the opening part 145 of the frame body 142 in the filter member 14.

Namely, the protruded adhesive may not reach the opening part 145 (i.e., beyond the inner periphery of the opening part 145 of the frame body 142).

Further, a method of forming the adhesive accumulation area is not limited to forming the R-shape. For example, chamfering may alternatively used to form the adhesive accumulation area.

By doing this, the movement of the bubbles generated on the downstream side of the filter member 14 and attached to the wall surface of the frame body 142 may not be prevented. Therefore, the bubbles may be promptly discharged toward the upstream side of the filter member 14.

Namely, by doing as described above, it is possible to restrain (contain) the extra adhesive (protruded beyond the area where the plane areas of the two parts are in contact with each other) within the adhesive accumulation area formed due to the R-shape or chamfering.

As a result, it may become possible to prevent the fine pores facing the opening part 145 from being sealed and the size of the opening part 145 from being reduced.

On the other hand, in the comparative example of the filter member 14 in which no such adhesive accumulation area where the protruded adhesive layer is to be accumulated is formed on periphery of the opening part 145 of the frame body 142 as illustrated in FIGS. 9A and 9B, the adhesive protruded from the area where the plane areas of the two parts are in contact with each other may further protrude beyond the edge part 145*a* of the frame body 142 and to the opening part 145.

As a result, the bubble accumulation area, as illustrated in FIG. 9B may be formed.

Due to the formed bubble accumulation area, the movement of the bubbles generated on the downstream side of the filter member 14 and attached to the wall surface of the frame body 142 toward upstream side may be prevented due to the adhesive layer 143 protruding to the opening part 145. As a result, the bubbles may be stagnated within the bubble accumulation area.

Further, in the filter member 14 in this embodiment of FIGS. 8A and 8*b*, the opening part 145 of the frame body 142 may be formed by press working. Due to the press working, a corner slope (i.e., the R-shape) for accumulating (containing) the protruded adhesive may be formed as the inner peripheral part of the opening shape.

Accordingly, the R-shape generating the adhesive accumulation area and the opening part 145 of the frame body 142 may be formed simultaneously. Therefore, a secondary process for forming the adhesive accumulation area may not be necessary. As a result, an extra cost may not be necessary.

Further, in this embodiment, the shape for containing the adhesive is formed only at the inner edge of the opening part 145.

Therefore, it may not necessary to increase the size of an area where the filter sheet member 141 and the frame body 142 overlap. As a result, it is not necessary to unnecessarily increase the size of the liquid droplet ejection head.

In the liquid droplet ejection head in this embodiment, the filter member 14 is formed by integrally joining the filter sheet member 141 and the frame body 142 with adhesive. As described above, the filter sheet member 141 includes plural fine pore to filter impurities from liquid supplied from the common liquid chamber 12 to the individual liquid chambers 203, and the frame body 142 includes the opening part 145 formed in the frame body 142.

Further, in the filter member 14, the fine pore formed area 144 in the filter sheet member 141 is larger than the opening part 145 of the frame body 142, and the R-shape is formed in the peripheral part of the opening part 145 of the frame body.

By having the features described above, in the liquid droplet ejection head in this embodiment, it may become possible to obtain stable liquid droplet ejection characteristics without increasing costs of parts and without unnecessarily increasing the size.

Next, filter members to be used in a liquid droplet ejection head according to another embodiment are described with reference to FIGS. 10A through 15C.

FIGS. 10A through 12C illustrate the filter members 14 according to this embodiment. On the other hand, FIGS. 13A through 15C illustrate comparative examples of the filter members according to an embodiment.

More specifically, FIGS. 10A, 11A, 12A, 13A, 14A, and 15A are top views of the filter members when viewed from the upstream side in the liquid supply direction.

FIGS. 10B, 11B, 12B, 13B, 14B, and 15B are cut-away views of the filter member when cut along lines in FIGS. 10A, 11A, 12A, 13A, 14A, and 15A, respectively. FIGS. 10C, 11C, 12C, 13C, 14C, and 15C are partially enlarged views of regions B in FIGS. 10A, 11A, 12A, 13A, 14A, and 15A, respectively, illustrating distribution of adhesive in the respective regions B.

First, a filter member 14 according to this embodiment is described with reference to FIGS. 10A through 12C. In the filter member 14 in this embodiment, it is assumed that the following relationship is satisfied.

size of R-shape≥size of region between fine pores

The term "size of R-shape" herein refers to the size (length) of the R-shape formed on the edge part of the opening part 145 of the frame body 142.

Also, the term "size of region between fine pores" herein refers to the size (length) of a region 141*a* between the fine pores adjacent to each other in the filter sheet member 141.

The "size of R-shape" is defined in the direction parallel to the protruding direction of adhesive protruding at the R-shape formed on the edge part of the opening part 145 of the frame body 142.

Figure 10B:
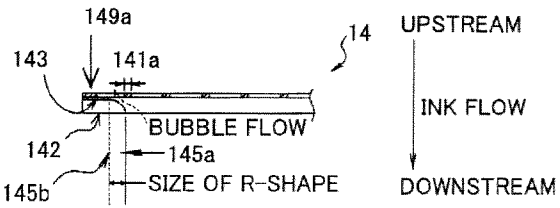
FIG. 10B is a cut-away view of the filter member in FIG. 10A when cut along a line Xb-Xb.

Namely, the "size of R-shape" refers to the length of the part sandwiched between an R-end part 145*b* and the end part 145*a* of the opening part 145 in FIG. 10B. The R-end part 145*b* herein refers to the boundary between the area of the R-shape and the plane area where no R-shape is formed in frame body 142.

Figure 10A:
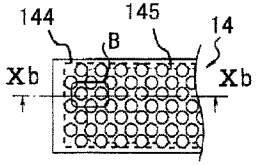
FIG. 10A is a top view of a filter member according to a second embodiment.
Figure 10C:
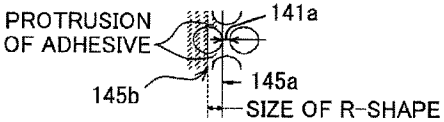
FIG. 10G is a schematic partially enlarged view of a region B in FIG. 10A, illustrating distribution of adhesive in the region B.

FIGS. 10A through 10C illustrate a state where, in the vicinity of a fine pore including the protruded adhesive and a fine pore including no protruded adhesive, the end part 145*a* of the opening part 145 of the frame body 142 faces the inner wall of the fine pore partially sealed with adhesive (adhesive layer 143).

Further, as illustrated in FIG. 10C, the R-end part 145*b* having an R-shape is not included in the region 141*a* between the fine pores adjacent to each other when viewed in the height direction (i.e., when viewed from the upper side or when viewed in the liquid flow direction). Therefore, the protruded adhesive (i.e., the adhesive layer 143) does not fully seal the fine pore (i.e., the left fine pore in FIG. 10C).

In this state, the size of the region 141*a* between the fine pores is less than the size of the R-shape. Therefore, the size of the area where bubbles are accumulated may become smaller, so that bubbles may be discharged to the upstream side by passing through the part which is not sealed with adhesive.

Accordingly, it may become possible to discharge the bubbles attached the wall surface of the frame body 142 to the upstream side of the filter member 14 more reliably.

Next, another state is described where the positional relationship between the end part 145*a* of the opening part 145 of the frame body 142 and the fine pores is different from that in the above state.

Figure 11A:
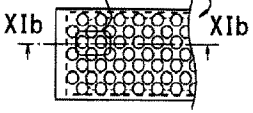
FIG. 11A is a top view of a filter member according to the second embodiment.
Figure 11B:
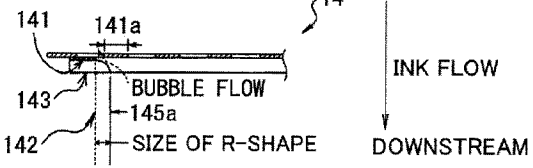
FIG. 11B is a cut-away view of the filter member in FIG. 11A when cut along a line XIb-XIb.
Figure 11C:
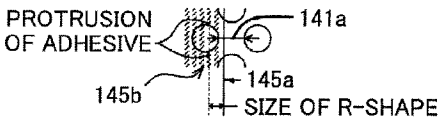
FIG. 11C is a schematic partially enlarged view of a region B in FIG. 11A, illustrating distribution of adhesive in the region B.

FIGS. 11A through 11C illustrate a state where, in the vicinity of a fine pore including the protruded adhesive and a fine pore including no protruded adhesive, the end part 145*a* of the opening part 145 of the frame body 142 faces the inner wall of the fine pore not having been sealed with adhesive.

Further, as illustrated in FIG. 11C, the R-end part 145*b* having an R-shape is not included in the region 141*a* between the fine pores adjacent to each other when viewed in the height direction (i.e., when viewed from the upper side or when viewed in the liquid flow direction). Therefore, the protruded adhesive does not fully seal the fine pore (i.e., the left fine pore in FIG. 11C).

In this state as well, the size of the region 141*a* between the fine pores is less than the size of the R-shape. Therefore, the size of the area where bubbles are accumulated may become smaller, so that bubbles may be discharged to the upstream side by passing through the part which is not sealed with adhesive.

Accordingly, it may become possible to discharge the bubbles attached the wall surface of the frame body 142 to the upstream side of the filter member 14 more reliably.

Figure 12A:
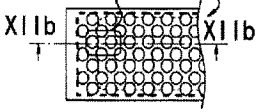
FIG. 12A is a top view of a filter member according to the second embodiment.
Figure 12B:
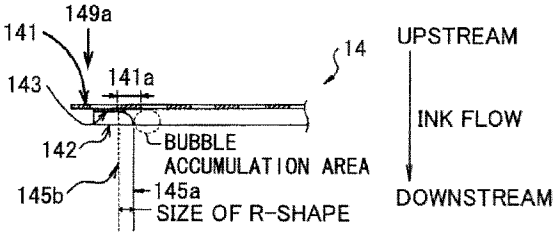
FIG. 12B is a cut-away view of the filter member in FIG. 12A when cut along a line XIIb-XIIb.
Figure 12C:
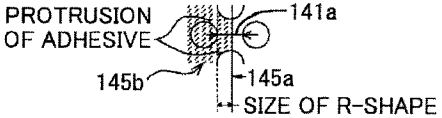
FIG. 12C is a schematic partially enlarged view of a region B in FIG. 12A, illustrating distribution of adhesive in the region B.

FIGS. 12A through 12C illustrate a state where, in the vicinity of a fine pore including the protruded adhesive and a fine pore including no protruded adhesive, the end part 145*a* of the opening part 145 of the frame body 142 faces the inner wall of the fine pore not having been sealed with adhesive.

Further, as illustrated in FIG. 12C, the R-end part 145*b* having an R-shape is included in the region 141*a* between the fine pores adjacent to each other when viewed in the height direction (i.e., when viewed from the upper side or when viewed in the liquid flow direction). Therefore, the protruded adhesive partially seals the fine pore (i.e., the left fine pore in FIG. 12C).

In this state, the fine pore corresponding to the fine pore formed area 144 may not be used for discharging bubbles. However, the size of the region 141*a* between the fine pores is less than the size of the R-shape. Therefore, the end part 145*a* of the opening part 145 does not face the region 141*a* between the fine pores. As a result, the bubble accumulation area of the bubbles adhered to the wall surface of the frame body 142 may not be formed.

As described with reference to FIGS. 10A through 12C, by satisfying the relationship "size of R-shape≥size of region between fine pores", it may become possible to maintain bubble discharge characteristics regardless of the positional relationship between the region 141*a* between the fine pores and the R-shaped part formed on the inner edge of the opening part 145.

Next, comparative examples of the filter member according to this embodiment are described with reference to FIGS. 13A through 15C. In the filter member in the comparative examples of FIGS. 13A through 15C, the following relationship is satisfied.

size of R-shape<size of region between fine pores

Figure 13A:
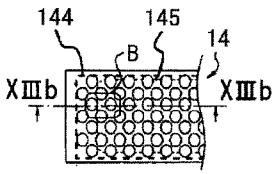
FIG. 13A is a top view of a comparative example of a filter member according to the second embodiment.
Figure 13B:
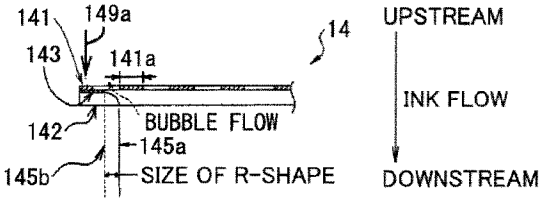
FIG. 13B is a cut-away view of the filter member in FIG. 13A when cut along a line XIIIb-XIIIb.
Figure 13C:
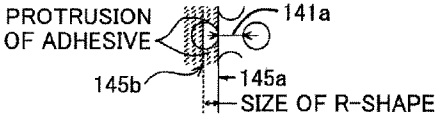
FIG. 13C is a schematic partially enlarged view of a region B in FIG. 13A, illustrating distribution of adhesive in the region B.

FIGS. 13A through 13C illustrate a state where, in the vicinity of a fine pore including the protruded adhesive and a fine pore including no protruded adhesive, the end part 145*a* of the opening part 145 of the frame body 142 faces the inner wall of the fine pore partially sealed with adhesive (adhesive layer 143).

Further, as illustrated in FIG. 13C, the R-end part 145*b* having an R-shape is not included in the region 141*a* between the fine pores adjacent to each other when viewed in the height direction (i.e., when viewed from the upper side or when viewed in the liquid flow direction).

Therefore, the protruded adhesive (i.e., the adhesive layer 143) does not fully seal the fine pore (i.e., the left fine pore in FIG. 13C).

In this state, bubbles may be discharged to the upstream side of the filter member 14 through a part (gap) of the fine pore which is partially sealed with adhesive. However, due to the size of the bubble accumulation area becoming greater than the filter member of this filter member, the efficiency of discharging bubbles may be reduced.

Figure 14A:
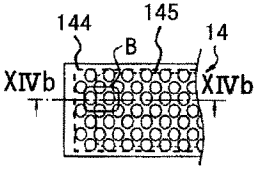
FIG. 14A is a top view of a comparative example of a filter member according to the second embodiment.
Figure 14B:
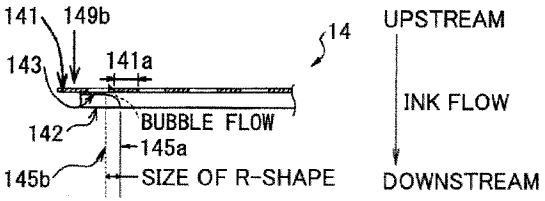
FIG. 14B is a cut-away view of the filter member in FIG. 14A when cut along a line XIVb-XIVb.
Figure 14C:
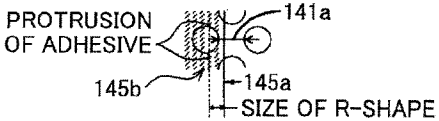
FIG. 14C is a schematic partially enlarged view of a region B in FIG. 14A, illustrating distribution of adhesive in the region B.

FIGS. 14A through 14C illustrate a state where, in the vicinity of a fine pore including the protruded adhesive and a fine pore including no protruded adhesive, the end part 145*a* of the opening part 145 of the frame body 142 faces the region 141*a* between the fine pores adjacent to each other.

Further, as illustrated in FIG. 14C, the R-end part 145*b* having an R-shape is not included in the region 141*a* between the fine pores adjacent to each other when viewed in the height direction (i.e., when viewed from the upper side or when viewed in the liquid flow direction).

Therefore, the protruded adhesive (i.e., the adhesive layer 143) does not fully seal the fine pore (i.e., the left fine pore in FIG. 14C).

In this state as well, similar to the state of FIGS. 13A through 13C, bubbles may be discharged. However, the efficiency of discharging bubbles may be reduced when compared with the filter member in this embodiment.

Figure 15A:
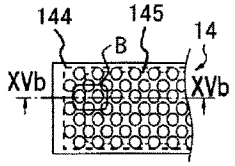
FIG. 15A is a top view of a comparative example of a filter member according to the second embodiment.
Figure 15B:
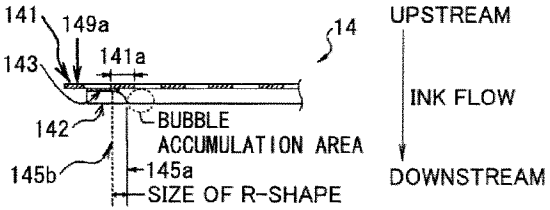
FIG. 15B is a cut-away view of the filter member in FIG. 15A when cut along a line XVb-XVb.
Figure 15C:
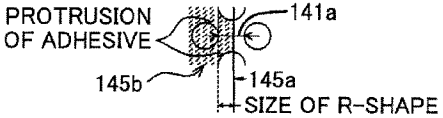
FIG. 15C is a schematic partially enlarged view of a region B in FIG. 15A, illustrating distribution of adhesive in the region B.

FIGS. 15A through 15C illustrate a state where, in the vicinity of fine pore including the protruded adhesive and a fine pore including no protruded adhesive, the end part 145*a* of the opening part 145 of the frame body 142 faces the region 141*a* between the fine pores adjacent to each other.

Further, as illustrated in FIG. 15C, the R-end part 145*b* having an R-shape is included in the region 141*a* between the fine pores adjacent to each other when viewed in the height direction (i.e., when viewed from the upper side or when viewed in the liquid flow direction). Therefore, the protruded adhesive (i.e., the adhesive layer 143) fully seals the fine pore (i.e., the left fine pore in FIG. 15C).

In the filter member in this embodiment as illustrated in FIGS. 12A through 12C, the region 141*a* between the fine pores adjacent to each other does not face the end part 145*a* of the opening part 145 of the frame body 142.

On the other hand, in the state of comparative examples of FIGS. 15A through 15C, due to the size of the region 141*a* between the fine pores adjacent to each other being greater than the size of the R-shape, the region 141*a* between the fine pores adjacent to each other may protrude beyond the end part 145*a* of the opening part 145 toward the opening part 145 direction. As a result, the bubble accumulation area may be formed.

As described above, when the following relationship is satisfied, it may become possible to reliably discharge the bubbles to the upstream side of the filter member 14.

size of R-shape≥size of region between fine pores

Next, the frame body including the filter member to be used for the liquid droplet ejection head according to another embodiment is described with reference to FIGS. 16A and 168.

Figure 16A:
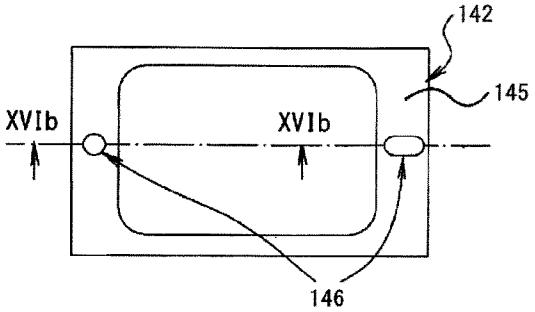
FIG. 16A is a top view of a frame body included in a filter member according to a third embodiment.
Figure 16B:
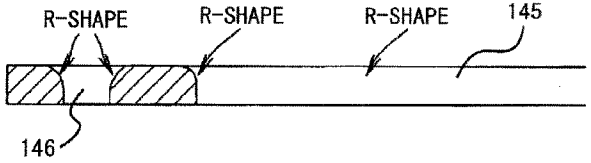
FIG. 16B is a cut-away view of the frame body in FIG. 16A when cut along a line XVIb-XVIb.

FIG. 16A is a top view of a frame body 142 included in the filter member 14 according to this embodiment. FIG. 168 is a cut-away view of the frame body 142 in FIG. 16A when cut along a line XVIb-XVIb.

In the filter member 14, when the frame 6 and the liquid chamber member 7 are assembled, pins are used to determine the positional relationship between the frame 6 and the liquid chamber member 7.

The frame body 142 is provided as a part that provides rigidity of the filter member 14. To that end, locating holes 146 are formed in manufacturing the frame body 142.

After that, the position of the frame body 142 with respect to the filter sheet member 141 is determined with pins (screws) to manufacture the filter member 14.

In manufacturing the frame body 142, when, for example, a SUS plate material is used as the base (main) material, the exterior (shape), the locating holes 146, and the opening part 145 are formed in the same press working.

Therefore, it may not necessary to perform additional working (process) to form the R-shape on the edge part of the opening part 145. Therefore, the cost may not be increased accordingly. Further, the R-shape may be formed as a corner slope on the locating holes 146 in the same press working.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid droplet ejection head comprising:

plural nozzles configured to eject liquid droplets;

plural individual liquid chambers in communication with the plural nozzles;

a common liquid chamber configured to supply liquid to the plural individual liquid chambers;

a filter sheet member disposed in a liquid flow path to supply liquid from the common liquid chamber to the plural individual liquid chambers and including plural pores formed therein to filter the liquid; and a frame body including an opening part and being in connection with the filter sheet member with adhesive applied therebetween, wherein a size of a region where the plural pores are formed in the filter sheet member is greater than a size of the opening part of the frame body, wherein the frame body is bonded on a bonding surface side thereof, via the adhesive, to the filter sheet member, wherein the frame body includes an R-shaped part formed as an inner peripheral part of the opening part and on a bonding surface side of the frame body, wherein the adhesive bonding the frame body to the filter sheet member protrudes into an adhesive accumulation area constituted by a space between the R-shaped part and the filter sheet member, and wherein a size of the R-shaped part in a protruding direction of the adhesive is greater than or equal to a size of an area between adjacent pores in the filter sheet member.

2. The liquid droplet ejection head according to claim 1, wherein the frame body includes locating holes for the connection to the filter sheet member.

3. A manufacturing method of manufacturing a liquid droplet ejection head according to claim 2, the manufacturing method comprising:

performing press working to form the frame body so that an exterior, the opening part, and the locating holes of the frame body are formed at a same time, wherein the frame body is made of SUS as a base material.

4. An image forming apparatus comprising:

the liquid droplet ejection head according to claim 1.

* * * * *